United States Patent [19]

Yamada et al.

[11] Patent Number: 4,606,808

[45] Date of Patent: Aug. 19, 1986

[54] METHOD FOR THE PREPARATION OF PITCHES FOR SPINNING CARBON FIBERS

[75] Inventors: Yasuhiro Yamada; Takeshi Imamura, both of Tosu; Masao Shibata, Ogoori; Seiji Arita, Tosu; Hidemasa Honda, Tokyo, all of Japan

[73] Assignee: Director-General of the Agency of Industrial Science & Technology, Tokyo, Japan

[21] Appl. No.: 603,203

[22] Filed: Apr. 23, 1984

[30] Foreign Application Priority Data

Apr. 22, 1983 [JP] Japan ..... 58-71991

[51] Int. Cl.[4] ..... C10C 1/00

[52] U.S. Cl. ..... 208/44; 208/22; 208/23; 208/39; 208/67; 208/71; 423/447.1

[58] Field of Search ..... 423/447.1; 208/44, 22, 208/39, 23, 67, 71

[56] References Cited

U.S. PATENT DOCUMENTS

| | | | |
|---|---|---|---|
| 2,772,219 | 11/1956 | Dunkel et al. | 208/23 |
| 2,992,181 | 7/1961 | Renner | 208/71 |
| 3,069,347 | 12/1962 | Bole et al. | 208/42 |
| 4,243,513 | 1/1981 | Horowitz et al. | 208/44 |
| 4,271,006 | 6/1981 | Dickakian | 208/44 |
| 4,272,501 | 6/1981 | Grekovich et al. | 423/447.1 |
| 4,339,328 | 7/1982 | Stadelhofer et al. | 208/23 |
| 4,363,715 | 12/1982 | Dickakian | 208/44 |
| 4,397,830 | 8/1983 | Uemura et al. | 208/40 |
| 4,427,531 | 1/1984 | Dickakian | 208/39 |
| 4,430,194 | 2/1984 | Omran et al. | 208/23 |
| 4,457,828 | 7/1984 | Lewis | 208/22 |
| 4,460,455 | 7/1984 | Moriya et al. | 208/71 |
| 4,460,557 | 7/1984 | Takashima et al. | 208/23 |
| 4,462,894 | 7/1984 | Moriya et al. | 208/71 |

FOREIGN PATENT DOCUMENTS

| | | | |
|---|---|---|---|
| 0026009 | 3/1981 | Japan | 423/447.1 |
| 1315940 | 5/1973 | United Kingdom | 208/23 |

*Primary Examiner*—Andrew H. Metz
*Assistant Examiner*—Helane Myers
*Attorney, Agent, or Firm*—Wyatt, Gerber, Shoup, Scobey and Badie

[57] ABSTRACT

The invention provides a method for the preparation of a pitch spinnable into pitch filaments as a precursor of carbon fibers starting from a pitch material such as coal tar and coal tar pitch. Different from the conventional procedure involving hydrogenation of the starting pitch, the starting pitch in the inventive method is first heated together with an aromatic oil, preferably, in the presence of a cracking catalyst such as silica-alumina and zeolite at 350° to 500° C. for 10 to 60 minutes under no pressurization with hydrogen and, after removal of insoluble materials, then heated at a temperature of 430° to 600° C. The thus obtained pitch for spinning has good spinnability and the carbon fibers prepared from the pitch have a unique microscopic structure and excellent physical properties exceeding by far the conventional pitch-based carbon fibers and approximating the HP-grade carbon fibers prepared from polyacrylonitrile fibers.

6 Claims, No Drawings

METHOD FOR THE PREPARATION OF PITCHES FOR SPINNING CARBON FIBERS

BACKGROUND OF THE INVENTION

The present invention relates to a method for the preparation of a pitch material for spinning into carbon fibers or, more particularly to a method for the preparation of a pitch material for carbon fibers starting from coal tar or coal tar pitch as a kind of heavy bituminous material and comprising two steps composed of the first step for the pretreatment of the starting material and the second step for the heat treatment of the pretreated material at a high temperature of 430° C. or higher within a relatively short time of 60 minutes or less. In particular, the pretreatment in the first step is carried out characteristically by heating the starting material at a temperature of 350° to 500° C. in the presence of an aromatic oil, optionally, containing catalyst for catalytic cracking.

Needless to say, carbon fibers are very promising as a future material usable in large quantities as a heat-insulating material, component of structural bodies including various sporting goods by utilizing their excellent properties such as the outstandingly high tensile strength, elastic modulus, heat resistance, resistance against chemicals and electric conductivity.

The carbon fibers constituting the major current of the products are produced from polyacrylonitrile (referred to as PAN hereinbelow) fibers or pitches. The PAN-based carbon fibers are known to have extremely high tensile strength and elastic modulus which sometimes exceed 350 kg/mm$^2$ and 40 tons/mm$^2$, respectively, and the highest values recently attained are about 500 kg/mm$^2$ of the tensile strength and about 2% of elongation. The problems in the PAN-based carbon fibers is the low yield of the product from the starting material which is usually 60% or smaller and the cost of the product due to the high production costs. The pitch-based carbon fibers are inferior in the properties to the PAN-based ones and the current products are the low-strength grade ones for general purpose having a tensile strength of 100 kg/mm$^2$ or smaller and high-strength grade carbon fibers of the so-called HP-grade are not being produced from pitches. Very recently, production of high-modulus pitch-based carbon fibers having a tensile strength of about 200 kg/mm$^2$ has been started although the quality of the product is not quite satisfactory.

In order to produce carbon fibers of HP-grade from a pitch as the starting material, it is essential, as is known, that the pitch for spinning is a carbonaceous mesophase pitch having optical anisotropy. The reason therefor is as follows. When a pitch is heated and carbonized through the reactions of thermal decomposition and thermal polymerization, a so-called liquid-phase carbonization process proceeds in which an optically anisotropic material, i.e. mesophase, is formed in the basically isotropic pitch and the mesophase propagates over whole volume of the pitch. Such a process of liquid-phase carbonization can take place only in a considerably large volume of the pitch and the process taking place in a microregion such as a fiber is different resulting in the carbonization being concluded without the molecular movement due to the disturbed mobility of the molecules forming the pitch material. Such a process is similar to the so-called solid-carbonization process. Therefore, the degree of the molecular orientation in the pitch fibers, i.e. the fibrous pitch obtained by spinning, is the determining factor for the grade of the resultant carbon fibers which may be of the GP-grade or HP-grade as a reflection of the difference whether the pitch for spinning is an optically isotropic pitch or the mesophase pitch. While it is essential that the pitch for spinning is a mesophase pitch in order to prepare HP-grade carbon fibers from pitches as the starting material, accordingly, the pitch therefor must be a specific one and the mesophase pitches prepared from ordinary pitches cannot or can hardly be spun into pitch fibers. The specific pitch materials suitable for the preparation of a spinnable mesophase pitch include the pitch obtained from tetrabenzophenazine, residual tars from the high temperature cracking of naphtha or crude oils at about 2000° C. and residual tars from the catalytic cracking of naphthas and the like in the FCC process. The availability of these pitch materials is, however, limited.

Pitch materials of good availability in large quantities such as coal tar pitches and residual pitches by the thermal cracking of naphtha are, however, not suitable as the starting material for a pitch for spinning, as is mentioned above, even when they are converted to a mesophase pitch by a mere pretreatment with heating. Therefore, several improvements have been proposed for the pretreatment of such pitch materials. One of the typical improved methods is the hydrogenation treatment disclosed, for example, in Japanese Patent Kokai No. 57-88016 according to which the starting pitch is subjected to a hydrogenation treatment under pressurized hydrogen together with an aromatic oil in the absence of a catalyst followed by a prolonged heat treatment at about 400° C. to form the mesophase. It is also proposed in Japanese Patent Kokai No. 58-18421 that a hydrogenated pitch is subjected to a heat treatment for a short time at 450° C. or higher under atmospheric or reduced pressure. In this method, the premesophase as a precursor of the mesophase is formed by the combination of the hydrogenation treatment in the first step and the short heat treatment at a high temperature in the second step and characteristic in that the pitch for spinning may not be a mesophase pitch. The premesophase pitch is optically isotropic when it is in the state of the pitch for spinning or the pitch fibers while it is imparted with optical anisotropy when the pitch fibers are carbonized by calcination.

Similarly to the above, an alternative method is proposed in Japanese Patent Kokai No. 57-100186 in which the material at the stage of the pitch for spinning is not necessarily a mesophase pitch. Such a pitch material is called a latent anisotropic pitch obtained by first heat-treating a starting pitch to form a mesophase followed by a reduction with hydrogen by use of ethylenediamine and lithium.

As is understood from the above description, one of the key problems in the technology of carbon fiber production is the preparation of a mesophase pitch or a similar pitch suitable to spinning with ease.

Although the preliminary hydrogenation of the starting pitch provides a very efficient means for the preparation of a pitch of easy spinning along with the broader versatility of the method in respect of the types of the starting pitches, the method unavoidably involves a problem of increased production cost of the carbon fibers and loss of the advantage of the low cost of the starting pitch. It has been recently proposed in this regard that a hydrogenated pitch is blended with an unhydrogenated pitch and the blend is heat-treated for a short time at 450° C. or above so that the hydrogen consumption in the hydrogenation treatment of the starting pitch can substantially be decreased without affecting the spinnability of the pitch for spinning prepared therefrom. This method provides a possibility of decreasing the hydrogen consumption to 50% or less of the conventional methods since the unhydrogenated pitch can be blended with the hydrogenated pitch in an amount of up to 50% of the latter and a possibility of decreasing the investment for the hydrogenation facilities as a result of the decrease in the amount of the pitch to be hydrogenated. At any rate, however, no method is known in which the hydrogenation treatment can be omitted at all.

SUMMARY OF THE INVENTION

An object of the present invention is to provide a method of pretreatment of a pitch material for the preparation of a pitch for spinning having excellent spinnability without the expensive hydrogenation treatment.

Another object of the invention is to provide a method for desirably modifying the physical properties of the carbon fibers prepared therefrom by adequately controlling the treatment process of the pitch materials.

Thus, the method of the invention for the preparation of a pitch as an intermediate of carbon fibers comprises heating a coal tar or a coal tar pitch at a temperature in the range from 350° to 500° C. for 10 to 60 minutes in the presence of an aromatic oil and, preferably, a catalyst for catalytic cracking under a spontaneous pressure followed by the removal of the insoluble solid matter and then a heat treatment at a temperature of 430° C. or higher for 60 minutes or shorter under atmospheric or reduced pressure.

DETAILED DESCRIPTION OF THE PREFERRED EMBODIMENTS

As is generally accepted, one of the features in the pitch-based carbon fibers is the relatively high elastic modulus. This feature is presumably due, in comparison with the PAN-based carbon fibers, to the fact that the layers of carbon constituting the filament each have a wide surface and are arranged in orientation in parallel to the direction of the fiber axis. The high value of the elastic modulus is a result of a high tensile strength or a low elongation. While the tensile strength is presumably determined by the length of the surface of the carbon layers and the presence or absence of the defects, the factor responsible to the elongation may be the curvature of the surface of the carbon layers. That is, the elongation of the carbon fibers would be larger when the surfaces of the carbon layers are not in parallel orientation to the fiber axis but have a smaller degree of parallel orientation.

In the pitch-based carbon fibers currently being produced, the starting pitch material is mainly composed of condensed polycyclic aromatic compounds and the pitch for spinning prepared therefrom is necessarily composed of the carbon layers having broad surfaces since the pitch for spinning is a mesophase or a precursor thereof obtained by the polycondensation of the condensed polycyclic aromatic compounds. This fact is advantageous for the increase of the elastic modulus of the carbon fibers but disadvantageous for the preparation of carbon fibers having a high elongation.

The present status of the carbon fiber technology has not yet reached a stage to control the physical properties of carbon fibers prepared from pitches as the starting material. Of course, control of the properties of carbon fibers in a broader sense is performed by using an optically isotropic pitch or a mesophase pitch leading to the GP-grade or HP-grade products, respectively, but nothing more.

This status of the prior art led to the above mentioned second object of the present invention to provide a means for controlling the properties of the carbon fibers by means of the treatment of the pitch materials.

In the following, the method of the present invention is described in detail.

The starting pitch used in the inventive method is a pitch of coal origin such as a coal tar and coal tar pitch. Although the petroleum-based pitches such as a naphtha tar are usually not suitable as such for the preparation of a pitch for spinning with good spinnability, possibilities of using a petroleum-based pitch material is held by blending it with a coal-based pitch material.

When a coal tar pitch which is solid at room temperature is used, it is necessary to add an aromatic oil thereto. Such an aromatic oil acts as a solvent when the mixture is heated so that advantages are obtained to prohibit formation of coke-like insoluble materials by the excessive polycondensation of the pitch and to facilitate handling of the pitch by the conversion of it from solid to liquid. Needless to say, no aromatic oil is needed when the pitch material is a coal tar. The aromatic oils usable here include the oils obtained by the distillation of coal tars such as naphthalene oil, creosote oil, absorption oil, anthracene oil and the like and the light oils mainly composed of naphthalene and the like obtained as a byproduct in the cracking of naphthas. These aromatic oils are used in an amount in the range from 50 to 200% by weight or, preferably, from 50 to 100% based on the starting pitch. When the amount of the aromatic oil is smaller than 50% by weight, the mixture with the solid pitch is still in a semi-solid state so that the difficulty in handling cannot be removed. An amount of the aromatic oil in excess of 200% by weight is economically undesirable because of the large volume of the material under handling.

The method of the present invention is performed, in the first embodiment, by the heat treatment of a starting pitch at 350° to 500° C. in the presence of an aromatic oil or, in the second embodiment, by the heat treatment of the starting pitch admixed with a cracking catalyst in the presence of an aromatic oil. The cracking catalyst here implied is a silica-alumina catalyst or a zeolite catalyst used in the reforming of gasoline. The amount of the cracking catalyst should be 20% by weight or less based on the starting pitch with no additional advantages by further increasing the amount thereof.

The starting pitch, aromatic oil and cracking catalyst, when used, are introduced into an autoclave or a sealable reaction vessel and heated for 10 to 60 minutes at a temperature in the range from 350° to 500° C. or, preferably, from 350° to 450° C. with the vessel hermetically sealed. No intentional pressurization is necessary in this treatment but the sealed reaction vessel prevents dissipation of the aromatic oil out of the reaction vessel and the treatment is performed under a spontaneously produced pressure. The treatment time should be determined in accordance with the temperature and a temperature higher than 430° C. requires a shorter treatment time in order to prevent formation of insoluble materials by the excessive reaction of the thermal polymerization while a lower temperature requires a somewhat increased treatment time. At any rate, a treatment time of 60 minutes is sufficiently long even at 350° C. of the treatment temperature.

The pitch mixture after completion of the above mentioned heat treatment is subjected to the removal of the insoluble solid matter originally contained or formed by the treatment as well as the catalyst by a suitable method such as filtration and centrifugal separation conventionally used for solid-liquid separation. Any pitch material originally contains free carbon as an insoluble solid material while an excessive heat treatment may result in the formation of the mesophase carbon which is removed together with the free carbon to leave no adverse effects on the spinnability of the pitch for spinning prepared therefrom. Nevertheless, an excessive heat treatment should be avoided to a possible extent in consideration of the material loss caused by the formation of the mesophase carbon.

The treated pitch mixture freed from the insoluble solid material is subjected, if desired, to distillation with an object to recover the aromatic oil. The recovered aromatic oil can be used as such in the next run of the treatment of the starting pitch material. The treated pitch either before or after the recovery of the aromatic oil is processed to a pitch for spinning by the heat treatment for a short time at a high temperature of 430° C. or higher. That is, the treated pitch is put into a vessel capable of being evacuated or equipped with a means for gas blowing and the vessel is introduced into a furnace heated in advance at a temperature sufficiently high so that the treated pitch is rapidly heated up to a desired remperarure or 430° C. or higher. The time for keeping the treated pitch at the heating temperature is 60 minutes or less and the time is shorter at a higher temperarure and longer at a lower temperature as a matter of course.

Selection of the treatment conditions in this case is very important in order to obtain a pitch for spinning having excellent spinnability. This means that the formation of the mesophase is a result of the thermal polymerization reaction taking place in this treatment along with the removal of the low boiling point constituents. When removal of the low-boiling constituents is incomplete, extreme difficulties are encountered in the spinning or spinning is eventually impossible with phase separation as a result of the isolation of the low-boiling constituents in the course of spinning. Further, it should be noted that an excessive extent of the treatment with formation of a too much amount of the mesophase is undesirable because of the increase in the softening temperature of the pitch requiring a higher spinning temperature to cause denaturation of the pitch in the course of spinning. The above mentioned rapid temperature elevation of the pitch up to the desired heating temperature is advantageous because lagging of the mesophase formation in time can be prevented thereby so that the mesophase is imparted with uniformized properties to form a homogeneous phase in the step of spinning.

The parameters characterizing a pitch for spinning having excellent spinnability in general include a softening point in the range from 240° to 300° C. and a content of the benzene-insoluble fraction in the range from 85 to 95% by weight. A pitch for spinning containing 80% by weight or less of the benzene-insoluble fraction is susceptible to ready phase separation in the course of spinning. The content of the quinoline-insoluble fraction should be at least 10% by weight and the spinnability of the pitch for spinning is almost independent on the content of the quinoline-insoluble fraction in the range from 10 to 60% by weight. The content of the fixed carbon should be at least about 90% by weight in the pitch for spinning. The above mentioned parameters are each determined according to the procedure specified in JIS K 2425.

A pitch for spinning having the above specified values of the parameters can be prepared by adequately selecting the conditions in the heat treatment including the degree of evacuation or rate of gas blowing, temperature and time. Apart from the above described method of the so-called single-step heat treatment in which the pitch is kept for a predetermined length of time at a constant temperature of 430° C. or higher, a method of two step treatment can be undertaken in which the pitch is first heated up to a temperature of 450° C. or higher and, when this temperature has been reached, the temperature is immediately decreased down to 400° to 430° C. where the pitch is kept for a predetermined length of time. This latter method is advantageous in that the heating time can be selected from a wider range for the preparation of a pitch having desired properties due to the extension of the treatment time as a result of the decreased temperature along with the more complete removal of the low boiling constituents.

The pitch for spinning obtained in this manner is suitable for the conventional method of melt spinning. Thus, the pitch for spinning is taken and melted with heating in a spinning cylinder having a spinneret of 0.3 to 0.5 mm diameter and the molten pitch is extruded out of the spinneret by pressurizing with a gas or by pressing with a piston into a filament which is wound up on a drum rotating at a constant velocity to give a continuous length pitch filament. The spinning can be performed with the peripheral velocity of the rotating drum of 300 m/minute or larger to give a pitch filament of about 10 μm diameter while a pitch filament of a diameter as fine as about 7 μm can be obtained in this manner. The temperature of the molten pitch should be controlled within a 40° to 80° C. range in order to facilitate spinning. The thus prepared pitch filament is then subjected to an infusibilization treatment by heating in air up to a temperature of about 300° C. followed by carbonization in an inert gas into a carbon fiber. If desired, the carbon fiber is converted into a graphitized fiber by the calcination at a temperature of 2000° C. or higher.

As is described above, a pitch for spinning having good spinnability can be prepared according to the inventive method without the hydrogenation treatment although the mechanism thereof is not well understood. It is presumed, however, from the results of the analyses of the starting pitch material, that the aromatic oil and the gaseous products after the treatment in the presence of the catalyst to show the formation of considerable volumes of hydrogen and methane that there are possibilities of hydrogenation and scission of the side chains on the aromatic nuclei. As a matter of course, the volume of the gases formed in this case is increased by the presence of the catalyst. When comparison is made with the treatment undertaken under the same conditions of the treatment but without the use of the catalyst, the presence of the catalyst increases the volume of the gaseous products by about 1.5 times and hydrogen and methane constitute about 80% of the gaseous products.

More characteristic features in this case consist in the structure of the carbon fibers and the physical properties thereof as a reflection of the structure. As is mentioned above, the carbon fibers obtained from a hydrogenated pitch have parallel orientation of the carbon layers having large surfaces in the direction of the fiber axis. Such an orientation can readily be observed by the examination of a broken surface perpendicular to the fiber axis by use of a scanning electron microscope. The examination of the fiber cross section by use of a scanning electron microscope is facilitated by the graphitization treatment of the carbon fiber at 2000° C. or higher. For example, a radial and coaxial orientation of the surfaces of the carbon layers was found in the broken cross section of a carbon fiber obtained from a pitch after the hydrogenation treatment of the starting pitch A used in Example 1 given later by use of tetrahydroquinoline according to the method described in Japanese Patent Kokai No. 58-18421. On the contrary, no orientation of the carbon layers is found in the structure of the carbon fibers prepared from the same starting pitch material after the treatment in accordance with the method of the present invention. Such a difference in the structure reflects on the difference in the physical properties of the carbon fibers. Although the tensile strength of the carbon fibers is 200 kg/mm$^2$ or larger in both cases after calcination at 1000° C. with no great difference, there is a great difference in the elongation between the conventional and inventive carbon fibers. For example, the elongation of the carbon fibers prepared from a pitch after the conventional hydrogenation treatment is 1.5 to 1.8% and 0.4 to 0.5% by the calcination at 1000° C. and 2800° C., respectively, while the corresponding values in the carbon fibers according to the present invention are 2.0 to 2.5% and 0.7 to 1.0%, respectively. Furthermore, a still more remarkable difference is found in the structure-sensitive electric resistivity of the carbon fibers graphitized at 2000° C. or higher. For example, the specific resistivity of the carbon fibers graphitized at 2800° C. is 2 to $3\times10^{-4}$ ohm·cm or 4 to $8\times10^{-4}$ ohm·cm depending on the pitch for spinning which has been hydrogenated according to the conventional method or treated according to the method of the present invention, respectively. Further, it should be noted that the value of the specific resistivity is subject to changes depending on the temperature of the pitch under spinning as is shown in the Examples given later. In this regard of the specific resistivity of the carbon fibers graphitized at 2800° C., it can be said that the carbon fibers obtained according to the invention are medium between the commercially available mesophase pitch-based carbon fibers and PAN-based carbon fibers since the typical values of the specific resistivity are 3 to $4\times10^{-4}$ ohm·cm for the former and 9 to $10\times10^{-4}$ ohm·cm for the latter.

As is understood from the above description, the carbon fibers obtained in accordance with the method of the present invention are novel and unique and not known hitherto in respect of the structure and the physical properties.

In the following, the method of the present invention is described in more detail by way of examples.

EXAMPLE 1

Two kinds of the coaltar pitches A and B were used as the starting pitch, of which the values for the characterization are given in Table 1 below.

TABLE 1

| Type | Softening point, °C. | Fixed carbon, % by weight | Benzene-insoluble matter, % by weight | Quinoline-insoluble matter, % by weight |
|---|---|---|---|---|
| A | 83 | 55.6 | 38.6 | 5.6 |
| B | 78 | 62.2 | 25.6 | 4.1 |

The aromatic oil was a fraction boiling at 200° C. or below under a pressure of 10 mmHg in the distillation of an anthracene oil under reduced pressure.

The starting pitch and the anthracene oil were introduced into an autoclave of 2 liter capacity each in a specified amount and, after replacement of the air inside with argon, the autoclave was closed with the inside pressure equal to atmospheric. Thereafter, the stirrer of the autoclave was driven and the temperature was increased at an average rate of temperature elevation of 2.5° C./minute up to a specified temperature in the range from 350° to 490° C. The temperature reached was maintained for a specified length of time and the autoclave was taken out of the furnace to be cooled down to room temperature. The content of the autoclave was completely washed out with anthracene oil and heated at about 90° C. followed by the settling of the insoluble materials by centrifuge. The supernatant liquid portion was filtered by use of a filter paper under suction. The insoluble residue on the filter paper was admixed a fresh portion of anthracene oil to be again centrifuged and the supernatant liquid portion was filtered under suction. The insoluble material was thus washed by repeating the above procedure three times followed by washing with benzene to remove the anthracene oil and dried. The thus obtained insoluble material was recorded as the anthracene oil-insoluble matter. The filtrates obtained in the above described procedures of filtration were combined altogether and subjected to distillation under reduced pressure to recover the fraction boiling at 25 ° C. or below under a pressure of 10 mmHg leaving a residue which was the treated pitch.

A 100 g portion of the treated pitch obtained in the above described first step was introduced into a cylindrical glass vessel equipped with a three-necked covering, which was put in the upper part of a furnace heated in advance at a temperature of 50° C. to melt the pitch therein. A glass tube connected to a nitrogen gas cylinder was inserted from the center opening of the three-necked covering to reach the bottom of the vessel. One of the two side openings was used for insertion of a thermocouple for the temperature measurement of the pitch and the other was used for a gas outlet tube leading to a cold trap for the distillate. When the temperature of the pitch in the vessel had reached 300° C., the vessel as a whole was put into the furnace along with introduction of nitrogen gas at a rate of 5 liters/minute while the temperature was further increased. After a temperature of 470° C. had been reached, the pitch was kept at this temperature for a specified length of time and then the vessel was immediately taken out of the furnace to be cooled down to room temperature. The thus obtained pitch was the pitch for spinning used subsequently.

Table 2 below summarizes the data for the amounts of the starting pitch and the anthracene oil taken, conditions, i.e. temperature and time, of the treatment and the amount of the anthracene oil-insoluble matter in 11 runs of the first-step treatment No. 1 to No. 11. Table 3 below summarizes the conditions for the treatment of the intermediate pitches obtained in the first-step treatment excepting Nos. 3, 6 and 10, yield of the pitches for spinning obtained in this second-step treatment and the properties of the pitches for spinning.

TABLE 2

| Experiment No. | Pitch Type | Pitch Amount, g | Anthracene oil, g | Treatment Temp., °C. | Treatment Time, minutes | Insoluble matter in anthracene oil, % by weight |
|---|---|---|---|---|---|---|
| 1 | A | 417 | 319 | 350 | 60 | 4.1 |
| 2 | A | 419 | 320 | 370 | 60 | 4.9 |
| 3 | A | 404 | 319 | 390 | 60 | 6.4 |
| 4 | A | 405 | 305 | 410 | 10 | 4.9 |
| 5 | A | 400 | 222 | 450 | 30 | 5.8 |
| 6 | A | 405 | 293 | 450 | 60 | 15.7 |
| 7 | A | 412 | 209 | 470 | 10 | 21.4 |
| 8 | A | 415 | 301 | 490 | 10 | 25.5 |
| 9 | B | 408 | 309 | 350 | 60 | 5.6 |
| 10 | B | 412 | 303 | 390 | 60 | 9.5 |
| 11 | B | 313 | 320 | 470 | 10 | 19.6 |

TABLE 3

| Experiment No. | Treated pitch No. (cf. Table 2) | Treatment Temp., °C. | Treatment Time, minutes | Yield, % by weight | Softening point, °C. | Fixed carbon, % by weight | Benzene insoluble matter, % by weight | Quinoline-insoluble matter, % by weight |
|---|---|---|---|---|---|---|---|---|
| 1 | 1 | 470 | 10 | 35.8 | 273 | 90.9 | 88.8 | 19.2 |
| 2 | 2 | 470 | 10 | 38.0 | 277 | 88.5 | 90.4 | 30.9 |
| 3 | 4 | 470 | 10 | 44.7 | 287 | 91.9 | 87.3 | 26.2 |
| 4 | 5 | 470 | 10 | 48.6 | 278 | 90.1 | 87.9 | 19.2 |
| 5 | 7 | 470 | 15 | 41.4 | 307 | 90.8 | 92.8 | 56.0 |
| 6 | 8 | 470 | 10 | 48.2 | 256 | 89.6 | 89.1 | 12.2 |
| 7 | 9 | 470 | 10 | 40.7 | 279 | 89.7 | 90.6 | 30.6 |
| 8 | 11 | 470 | 10 | 43.1 | 281 | 93.0 | 92.1 | 33.3 |

Spinning of the pitches for spinning shown in Table 3 was undertaken in the following manner. Thus, about 10 g of the pitch for spinning were taken in a brass-made spinning cylinder having an inner diameter of 20 mm and a length of 150 mm and equipped with a spinneret having an opening of 0.5 mm diameter followed by melting with heating from outside and the molten pitch was extruded out of the spinneret by pressurizing with nitrogen gas. The thus extruded pitch filament was wound up on a rotating drum of 300 mm diameter. This spinning test was undertaken at varied temperatures of the pitch melt and under varied pressures of the pressurizing nitrogen gas to find the ranges of these parameters within which the spinning could be performed at a winding-up velocity of at least 300 m/minute. When the spinning of a pitch could be performed at a winding-up velocity of at least 300 m/minute, the pitch was evaluated as a pitch for spinning having good spinnability.

The pitch filament obtained by the spinning in this manner was then subjected to the infusibilization treatment by heating in air up to 300° C. at a rate of temperature elevation of 3° C./minute followed by keeping at this temperature for 20 to 30 minutes. The infusibilized pitch filament was further subjected to the carbonization treatment into carbon fibers by heating in an atmosphere of nitrogen at 1000° C. for 30 minutes after temperature elevation to this temperature at a rate of 20° C./minute. The thus prepared carbon fibers were tested for the physical properties according to the procedure specified in JIS R 7601 for "Testing methods of carbon fibers" to give the results shown in Table 4 below.

TABLE 4

| Pitch for spinning No. (cf. Table 3) | Pitch temperature, °C. | Fiber diameter, μm | Tensile strength, kg/mm² | Elongation, % |
|---|---|---|---|---|
| 1 | 384 | 15.6 | 238 | 1.7 |
| | 393 | 11.7 | 257 | 1.8 |
| | 402 | 12.5 | 247 | 1.7 |
| | 411 | 14.4 | 211 | 1.4 |
| 2 | 392 | 8.3 | 275 | 1.9 |
| | 402 | 9.4 | 255 | 1.8 |
| 3 | 400 | 12.2 | 236 | 1.7 |
| | 411 | 15.0 | 232 | 1.8 |
| | 418 | 11.5 | 200 | 1.7 |
| 4 | 358 | 18.7 | 239 | 1.6 |
| | 379 | 11.3 | 250 | 2.3 |
| | 400 | 9.1 | 278 | 2.1 |
| | 420 | 11.0 | 266 | 2.0 |
| 5 | 399 | 15.9 | 222 | 1.8 |
| | 415 | 12.0 | 241 | 1.7 |
| 7 | 399 | 20.8 | 178 | 1.9 |
| | 417 | 18.4 | 215 | 1.6 |
| 8 | 383 | 28.3 | 216 | 2.0 |
| | 402 | 15.6 | 260 | 2.4 |
| | 420 | 14.7 | 268 | 2.6 |
| | 429 | 17.8 | 214 | 2.1 |

EXAMPLE 2

Pitches for spinning were prepared in substantially the same procedure as in Example 1 from the starting coal tar pitch A or B except that the distilled oil of the anthracene oil was admixed with a silica-alumina catalyst for catalytic cracking.

Table 5 below summarizes the data of the conditions in the first-step treatment runs No. 12 to No. 25 as well as the amount of the anthracene oil-insoluble matter in each of the runs. Table 6 gives the treatment conditions of several of the treated pitches shown in Table 5 for the preparation of pitches for spinning and yields and properties of the thus obtained pitches for spinning. Further, Table 7 summarizes the spinning conditions of the pitches shown in Table 6 and the mechanical properties of the carbon fibers thus prepared.

As is understood by making comparison between Tables 2 and 4 and 5 to 7, clearly superior results were obtained by the presence of the catalyst in the anthracene oil, especially, when the treatment temperature was 400° C. or below.

TABLE 5

| Experiment No. | Pitch Type | Pitch Amount, g | Anthracene oil, g | Catalyst, g | Treatment Temp., °C. | Treatment Time, minutes | Insoluble matter in anthracene oil, % by weight |
|---|---|---|---|---|---|---|---|
| 12 | A | 403 | 313 | 32 | 350 | 60 | 4.8 |
| 13 | A | 406 | 324 | 26 | 370 | 60 | 4.6 |
| 14 | A | 403 | 299 | 21 | 380 | 60 | 4.8 |
| 15 | A | 413 | 318 | 26 | 390 | 60 | 5.7 |
| 16 | A | 402 | 298 | 40 | 410 | 10 | 5.6 |
| 17 | A | 414 | 211 | 40 | 430 | 60 | 11.6 |
| 18 | A | 419 | 231 | 32 | 470 | 10 | 13.4 |
| 19 | B | 407 | 304 | 28 | 350 | 60 | 7.2 |
| 20 | B | 415 | 309 | 27 | 390 | 60 | 7.5 |
| 21 | B | 310 | 292 | 26 | 410 | 60 | 6.8 |
| 22 | B | 410 | 207 | 20 | 430 | 60 | 14.6 |
| 23 | B | 308 | 305 | 16 | 450 | 10 | 13.2 |
| 24 | B | 310 | 329 | 12 | 470 | 10 | 17.8 |
| 25 | B | 309 | 296 | 17 | 470 | 60 | 35.9 |

TABLE 6

| Experiment No. | Treated pitch No. (cf. Table 5) | Treatment Temp., °C. | Treatment Time, minutes | Yield, % by weight | Softening point, °C. | Fixed carbon, % by weight | Benzene-insoluble matter, % by weight | Quinoline-insoluble matter, % by weight |
|---|---|---|---|---|---|---|---|---|
| 9 | 12 | 470 | 15 | 42.4 | 296 | 93.1 | 93.1 | 60.6 |
| 10 | 12 | 470 | 10 | 43.6 | 276 | 90.0 | 89.0 | 26.2 |
| 11 | 13 | 470 | 10 | 46.1 | 283 | 89.1 | 91.0 | 32.1 |
| 12 | 17 | 470 | 10 | 43.4 | 252 | 86.2 | 88.7 | 19.0 |
| 13 | 17 | 470 | 15 | 41.6 | 273 | 94.3 | 93.5 | 40.7 |
| 14 | 18 | 470 | 15 | 33.2 | 299 | 93.5 | 93.9 | 45.3 |
| 15 | 16 | 430 | 60 | 38.9 | 277 | 89.6 | 88.2 | 29.5 |
| 16 | 19 | 470 | 10 | 44.3 | 289 | 89.1 | 91.2 | 34.3 |
| 17 | 21 | 470 | 10 | 47.7 | 286 | 90.1 | 86.3 | 15.2 |
| 18 | 22 | 470 | 10 | 35.2 | 288 | 90.3 | 94.3 | 41.9 |
| 19 | 22 | 490 | 3 | 35.0 | 309 | 90.4 | 94.2 | 75.5 |
| 20 | 23 | 470 | 10 | 47.8 | 296 | 89.6 | 91.4 | 46.4 |
| 21 | 23 | 490 | 3 | 47.3 | 284 | 91.9 | 88.8 | 12.7 |
| 22 | 24 | 470 | 10 | 58.9 | 281 | 89.5 | 88.2 | 18.9 |

TABLE 7

| Pitch for spinning No. (cf. Table 6) | Pitch temperature, °C. | Fiber diameter, μm | Tensile strength, kg/mm$^2$ | Elongation, % |
|---|---|---|---|---|
| 10 | 393 | 13.2 | 245 | 1.8 |
| | 413 | 9.6 | 255 | 1.6 |
| 11 | 382 | 15.3 | 219 | 1.8 |
| | 396 | 13.8 | 247 | 1.6 |
| 13 | 375 | 13.0 | 224 | 1.9 |
| | 392 | 10.0 | 280 | 2.0 |
| | 409 | 8.2 | 254 | 1.8 |
| | 419 | 9.1 | 310 | 1.6 |
| 14 | 388 | 19.3 | 252 | 1.7 |
| | 407 | 9.9 | 229 | 1.7 |
| | 416 | 12.4 | 238 | 1.7 |
| | 425 | 11.6 | 226 | 1.6 |
| 15 | 388 | 22.7 | 215 | 1.6 |
| | 397 | 12.8 | 265 | 1.7 |
| | 407 | 11.0 | 319 | 1.8 |
| | 416 | 13.0 | 332 | 1.6 |
| 17 | 375 | 12.3 | 221 | 1.9 |
| | 393 | 15.1 | 199 | 1.8 |
| | 402 | 12.2 | 266 | 2.4 |
| | 412 | 14.5 | 240 | 2.4 |
| | 420 | 13.6 | 309 | 1.7 |
| 22 | 351 | 25.0 | 170 | 2.2 |
| | 366 | 21.0 | 224 | 2.0 |
| | 386 | 15.2 | 214 | 2.3 |
| | 405 | 14.2 | 225 | 2.2 |

EXAMPLE 3

The carbon fibers prepared in the above described Examples were graphitized by heating at 2800° C. in a Tammann electric furnace under an atmosphere of argon and the structure and electric resistivity of the graphitized carbon fibers were examined. For comparison, similar graphitization treatment was undertaken for the carbon fibers prepared after the conventional hydrogenation treatment of the same starting pitch with tetrahydroquinoline according to the procedure described in detail in Japanese Patent Kokai No. 58-18321.

Examination of the broken cross sections of these carbon fibers perpendicular to the fiber axis was performed by use of a scanning electron microscope to show a clear difference between those prepared by the conventional method and the inventive method. As is shown in the electron micrograph, the carbon fiber prepared from a hydrogenated pitch is composed of an arrangement of carbon layers having wide surfaces oriented in parallel to the fiber axis and the arrangement of the carbon layers can be varied including radial, random and coaxial ones relative to the center axis of the fiber. On the contrary, no such a laminar structure or a particularly structured texture is found in the broken cross section of the carbon fiber prepared according to the invention which is always random within the cross section. Such a random structure of the cross section is common to all of the carbon fibers prepared according to the invention although there is a trend that an increase in the temperature of the pitch under spinning has an insignificant effect of inducing growth of the laminar structure of the carbon layers.

Table 8 below shows the data of the specific resistivity of these graphitized carbon fibers. As is shown in this table, the resistivity of the conventional carbon fibers after the hydrogenation treatment is not influenced by the temperature of the pitch under spinning and has a value of 3 to $4\times10^{-4}$ ohm·cm while the value of the inventive carbon fibers is influenced by the temperature of the pitch within a considerably higher range of 4 to $8\times10^{-4}$ ohm·cm than the conventional ones with hydrogenation. This fact is presumably a reflection of the difference in the microscopic structure of the carbon fibers described above suggesting that the carbon fibers prepared according to the invention approximate the PAN-based carbon fibers having no definite laminar orientation of carbon layers.

TABLE 8

| Experiment No. in Table 4 or 7 | Pitch temperature, °C. | Specific resistivity, $\times 10^{-4}$ ohm · cm |
|---|---|---|
| Hydrogenated pitch | 350 | 4.2 |
| | 360 | 4.2 |
| | 370 | 4.0 |
| | 380 | 3.6 |
| No. 3 in Table 4 | 400 | 4.6 |
| | 411 | 4.2 |
| | 418 | 8.1 |
| No. 4 in Table 4 | 358 | 7.4 |
| | 379 | 6.9 |
| | 400 | 4.9 |
| | 420 | 5.6 |
| No. 13 in Table 7 | 375 | 6.0 |
| | 392 | 5.1 |
| | 409 | 4.0 |
| | 419 | 3.6 |

Comparative Example

Into a three-necked cylindrical glass vessel of 500 md capacity were introduced 300 g of the starting pitch B indicated in Table 1 and 150 g of a distilled oil of an anthracene oil and the pitch was melted by putting the vessel into a furnace heated in advance at 250° C. The mixture of the molten pitch and the aromatic oil was heated with agitation up to a temperature of 420° C. after temperature elevation at a rate of 3° C./minute and kept at this temperature for 120 minutes. Thereafter the vessel was taken out of the furnace and cooled to room temperature. The thus treated pitch was admixed with an about three times amount of an anthracene oil and dissolved therein by heating at about 90° C. followed by the removal of the insoluble material by centrifuging. The supernatant liquid portion was filtered by use of a filter paper and the anthracene oil was recovered from the filtrate by distillation under reduced pressure to leave a residue which was the treated pitch.

The treated pitch obtained in the above described manner was heated up to 470° C. in the same manner as in Example 1 and, upon reaching this temperature, immediately cooled to room temperature. The thus obtained residue pitch contained numberless tiny bubbles and had a softening point of 350° C. or higher so that the pitch was not spinnable at all. Accordingly, this pitch was further heated at 430° C. for 30 minutes and a barely spinnable pitch could be obtained thereby. The pitch for spinning thus obtained had a softening point of 293° C. and contained 89.2% by weight of fixed carbon, 87.6% by weight of benzene-insoluble matter and 48.8% by weight of quinoline-insoluble matter.

The above obtained pitch for spinning was subjected to a spinning test with varied temperatures of the pitch in the range from 350° to 420° C. only to find that the pitch being extruded out of the spinneret opening was inhomogeneous regardless of the pitch temperature resulting in frequent break of the filament so that winding-up of the pitch filament on the rotating drum was found to be entirely impossible.

For further comparison, the same procedure as above was repeated excepting the addition of 27.8 g of the same silica-alumina catalyst as used in Example 2 to the mixture of the pitch and anthracene oil. The results were that no conditions could be found for spinning the thus prepared pitch into pitch filaments despite the trials by widely varying each of the essential parameters in the spinning conditions.

What is claimed is:

1. A method for the preparation of a pitch spinnable into a pitch filament which comprises as a first step heating a mixture of a coal tar or a coal tar pitch and an aromatic oil in the presence of a cracking catalyst at a temperature from 350° to 500° C. for from 10 to 60 minutes in a closed vessel under a spontaneously produced pressure, and as a second step removing insoluble materials from the mixture and heating the mixture at a temperature in the range from 430° to 600° C. under atmospheric pressure or under reduced pressure in an inert atmosphere.

2. The method as claimed in claim 1 wherein the aromatic oil is a distilled oil of coal tar or a light oil which is a byproduct in the thermal cracking of naphtha.

3. The method as claimed in claim 1 wherein the amount of the aromatic oil is in the range from 50 to 200% by weight based on the coal tar or coal tar pitch.

4. The method as claimed in claim 1 wherein the cracking catalyst is a silica-alumina catalyst or a zeolite catalyst.

5. The method as claimed in claim 1 wherein the amount of the cracking catalyst is in the range from 2 to 20% by weight based on the coal tar or coal tar pitch.

6. A method as claimed in claim 1 in which the mixture is initially heated to at least 450° C. and then quickly decreased to a temperature of 400° to 430° C. as the temperature of the first step.

* * * * *